US007401543B2

(12) United States Patent
Curtis

(10) Patent No.: US 7,401,543 B2
(45) Date of Patent: Jul. 22, 2008

(54) PUMP SEALING APPARATUS

(75) Inventor: Douglas Allan Curtis, Troutman, NC (US)

(73) Assignee: Hargraves Technology Corporation, Mooresville, NC (US)

( * ) Notice: Subject to any disclaimer, the term of this patent is extended or adjusted under 35 U.S.C. 154(b) by 0 days.

(21) Appl. No.: 10/598,814

(22) PCT Filed: Mar. 16, 2005

(86) PCT No.: PCT/US2005/008777

§ 371 (c)(1),
(2), (4) Date: Sep. 12, 2006

(87) PCT Pub. No.: WO2005/089389

PCT Pub. Date: Sep. 29, 2005

(65) Prior Publication Data

US 2007/0157800 A1 Jul. 12, 2007

Related U.S. Application Data

(60) Provisional application No. 60/553,692, filed on Mar. 16, 2004.

(51) Int. Cl.
*F16J 3/00* (2006.01)
*F04B 45/00* (2006.01)

(52) U.S. Cl. ..... 92/98 R; 417/413.1

(58) Field of Classification Search ..... 92/96, 92/98 R; 417/395, 413.1
See application file for complete search history.

(56) References Cited

U.S. PATENT DOCUMENTS

| | | | | |
|---|---|---|---|---|
| 5,275,541 | A | 1/1994 | Becker et al. | |
| 6,338,295 | B1 | 1/2002 | Kubota et al. | |
| 6,579,074 | B2 * | 6/2003 | Chiba | 417/395 |
| 6,776,591 | B1 | 8/2004 | Rinninger et al. | |
| 7,293,967 | B2 * | 11/2007 | Fukano et al. | 92/98 D |
| 2004/0076526 | A1 | 4/2004 | Fukano et al. | |

* cited by examiner

*Primary Examiner*—Thomas E Lazo
(74) *Attorney, Agent, or Firm*—Adams Intellectual Property Law, P.A.

(57) ABSTRACT

A sealing arrangement for a pump includes a first member having a peripheral wedge-shaped pocket; a second member with a rim opposed to the pocket; and a diaphragm disposed between the two members. The diaphragm includes a central stem, a disk-shaped head attached to the stem, and an upstanding bead disposed around the periphery of the head. The bead includes a first angled surface and a second angled surface. The bead is received in the pocket so as to form two separate, spaced-apart sealing surfaces between the diaphragm and the first member. The sealing arrangement may also include a gasket made from a resilient material and having a flat web with a circular crosssection bead disposed in a gland between two members. The dimensions of the bead and the gland are selected such that the bead is diametrically compressed at least about 40% from its free state.

20 Claims, 5 Drawing Sheets

PUMP SEALING APPARATUS

BACKGROUND OF THE INVENTION

This invention relates generally to pumps and more particularly to a diaphragm pump. Diaphragm pumps are assembled with multiple components creating joints that must be sealed in order to insure a leak free condition. Current diaphragm pump sealing technology typically has not produced pumps that are leak free under all conditions.

There are two primary joints that must be considered in evaluating leaks in miniature diaphragm pumps. The first is the seal joint around the perimeter of the diaphragm created when the diaphragm is sandwiched between the pump head, generally an assembly of multiple components, and the pump body. This seal joint is both a seal and a clamping point to secure the diaphragm in place during operation of the pump. Therefore, if a good seal is present but the diaphragm is not properly clamped, a shift in the diaphragm due to the operation of the pump could likely cause a failure in the sealing. The second seal area is that between the components that house the pump valves. This is normally a split in the pump head creating an upper component typically referred to as the "head" and a lower component typically referred to as the "chamber". There are several methods currently used to create a seal at this joint ranging from gaskets that are integrated with the valve(s) to separate gaskets that surround the valve sections of the joint.

Current technologies used for these joints have historically not been successful in maintaining a leak free pump under all conditions the pump may be subjected to. These conditions include higher pressures, extremely viscous fluids, fluids with very low surface tension, and extreme thermal variations, among others. Accordingly, there is a need for a diaphragm pump having robust sealing.

BRIEF SUMMARY OF THE INVENTION

Accordingly, it is an object of the invention to prove a diaphragm pump having robust sealing characteristics.

It is another object of the invention to provide a diaphragm having dual sealing surfaces.

It is another object of the invention to provide a diaphragm pump having a gasket with a substantial amount of compression.

These and other objects are met by the present invention, which in one embodiment provides a sealing arrangement for a pump, including: a first member having a peripheral wedge-shaped pocket formed therein; a second member with a rim opposed to the pocket; and a diaphragm disposed between the first and second members. The diaphragm includes: a central stem having a longitudinal axis; a disk-shaped head attached to the stem; and an upstanding bead disposed around the periphery of the head, the bead including a generally, radially-outwardly facing first angled surface, and a generally radially-inwardly facing second angled surface. The bead is received in the pocket so as to form two separate, spaced-apart sealing surfaces between the diaphragm and the first member.

According to another embodiment of the invention, each of the angled surfaces is disposed at an angle of about 10 degrees to about 30 degrees to the longitudinal axis.

According to another embodiment of the invention, each of the angled surfaces is disposed at an angle of about 15 degrees to the longitudinal axis.

According to another embodiment of the invention, the bead includes a substantially flat, axially-facing surface disposed between the angled surfaces.

According to another embodiment of the invention, the diaphragm includes a substantially parallel-sided first flat portion disposed adjacent to the second angled surface, and the first flat portion is clamped between the first and second members.

According to another embodiment of the invention, the diaphragm includes a substantially parallel-sided second flat portion disposed adjacent to the second angled surface; and the second flat portion is clamped between the first and second members.

According to another embodiment of the invention, a V-shaped groove is formed in the rim.

According to another embodiment of the invention, the diaphragm comprises a material selected from the group consisting of a fluoroelastomer and ethylene propylene diene terpolymer.

According to another embodiment of the invention, the pocket includes a generally radially-outwardly facing third angled surface, and a generally radially-inwardly facing fourth angled surface.

According to another embodiment of the invention, a sealing arrangement includes: first and second members each having a planar surface, the members cooperatively defining a gland for receiving a gasket; a gasket made from a resilient material disposed in the gland, the gasket including a flat web, and a circular cross-section first bead extending in a first closed path. The dimensions of the first bead and the first and second members are selected such that the first bead is diametrically compressed at least about 40% from its free state.

According to another embodiment of the invention, the first bead is compressed about 50% to about 60% from its free state.

According to another embodiment of the invention, the gasket further includes a circular cross-section second bead extending in a closed path inside of the first closed path and received in the gland. The dimensions of the second bead and the first and second members are selected such that the second bead is diametrically compressed at least about 40% from its free state.

According to another embodiment of the invention, the second bead is compressed about 50% to about 60% from its free state.

According to another embodiment of the invention, the diaphragm comprises a material selected from the group consisting of a fluoroelastomer and ethylene propylene diene terpolymer.

According to another embodiment of the invention, a pump includes a pump head having a peripheral wedge-shaped pocket formed therein; a body having a rim opposed to the pocket; and a diaphragm disposed between the pump head and the body. The diaphragm includes a central stem positioned having a longitudinal axis; a disk-shaped head attached to the stem; and an upstanding diaphragm bead disposed around the periphery of the head, the diaphragm bead including a generally radially-outwardly facing first angled surface, and a generally radially-inwardly facing second angled surface. The diaphragm bead is received in the pocket so as to form two separate sealing surfaces between the pump head and the diaphragm.

According to another embodiment of the invention, the pump head comprises a chamber and a head having mating planar surfaces, the chamber and the head cooperatively defining a gland for receiving a gasket. The pump further includes a gasket made from a resilient material disposed in the gland. The gasket includes a flat web, and a circular cross-section first bead extending in a first closed path. The dimensions of the first bead and the first and second members are selected such that the first bead is diametrically compressed at least about 40% from its free state.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
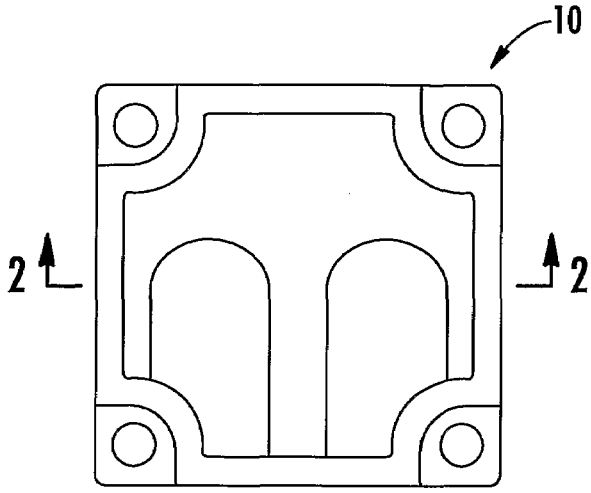
FIG. 1 is a top view of a diaphragm pump constructed in accordance with the present invention.
Figure 2:
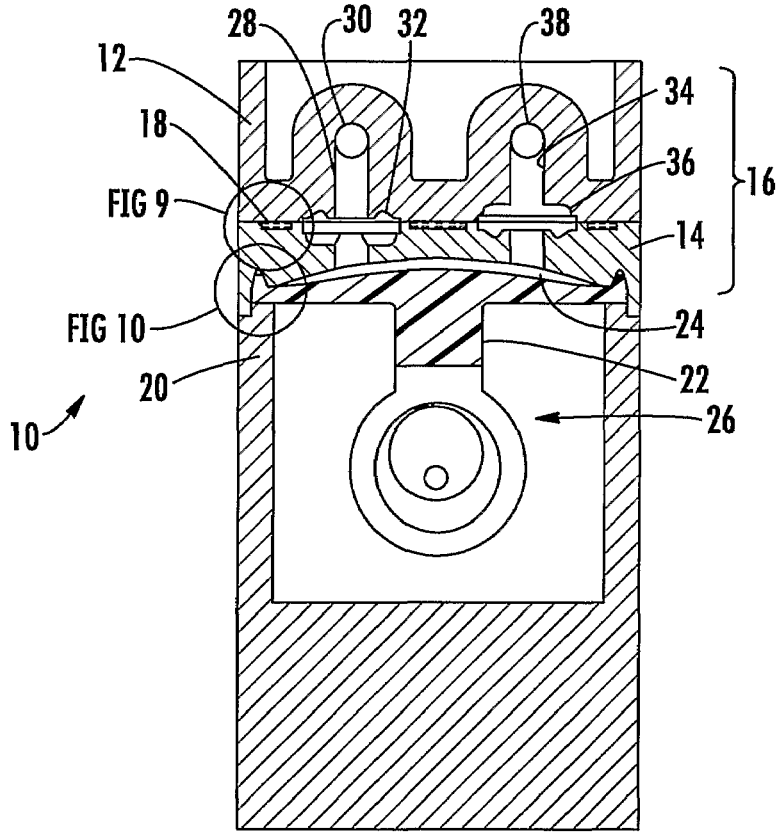
FIG. 2 is a view taken along lines 2-2 of FIG. 1.

Referring to the drawings wherein identical reference numerals denote the same elements throughout the various views, FIGS. 1 and 2 illustrate an exemplary diaphragm pump 10 constructed in accordance with the present invention. A head 12 is attached to a chamber 14. The head 12 and the chamber 14 are referred to collectively as a pump head 16. The joint between the head 12 and the chamber 14 is sealed with a gasket 18. A pump body 20 is attached to the lower end of the pump head 16. A flexible diaphragm 22 is disposed between the pump head 16 and the body 20. The diaphragm 22 is the primary working part of the pump 10, and also seals the joint between the pump head 16 and the chamber 14, thus forming a working space 24. The diaphragm 22 is connected to a source of motive power such as an electric motor through a suitable connection, for example by the crank arm and cam assembly 26 illustrated. An inlet passage 28 is formed in the pump head 16 extending from an inlet port 30 through an inlet valve pocket 32 to the working space 24. An outlet passage 34 is formed in the pump head extending from the working space 24 through an outlet valve pocket 36 to an outlet port 38.

Figure 3:
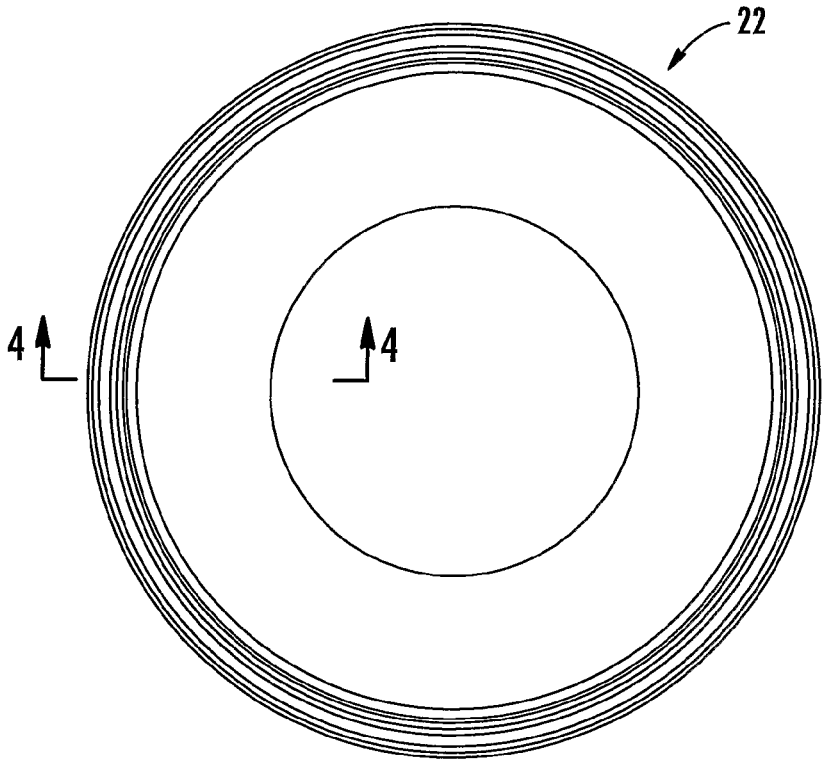
FIG. 3 is a top view of a pump diaphragm constructed in accordance with the present invention.
Figure 4:
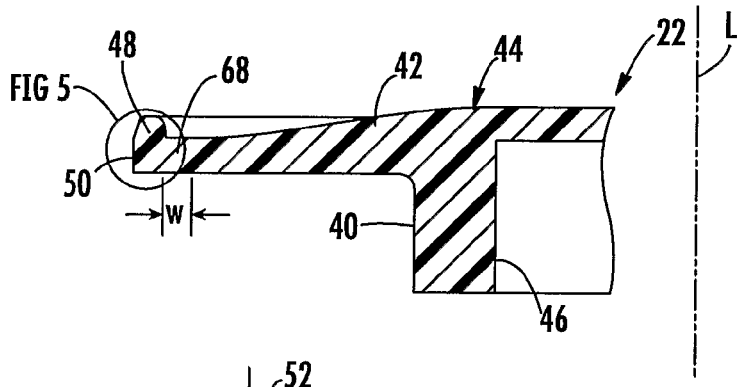
FIG. 4 is a view taken along lines 4-4 of FIG. 3.
Figure 5:
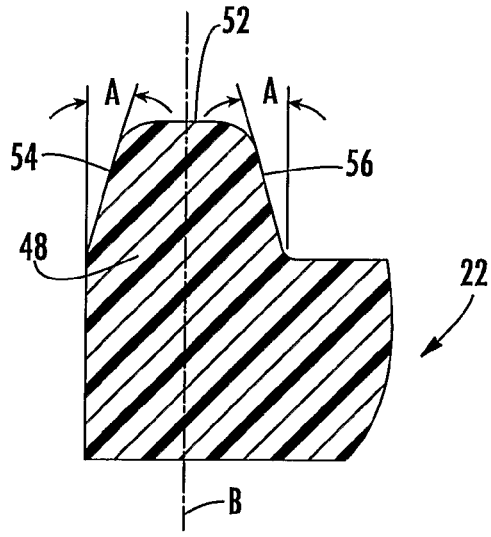
FIG. 5 is an enlarged view of a portion of the diaphragm of FIG. 4.
Figure 6:
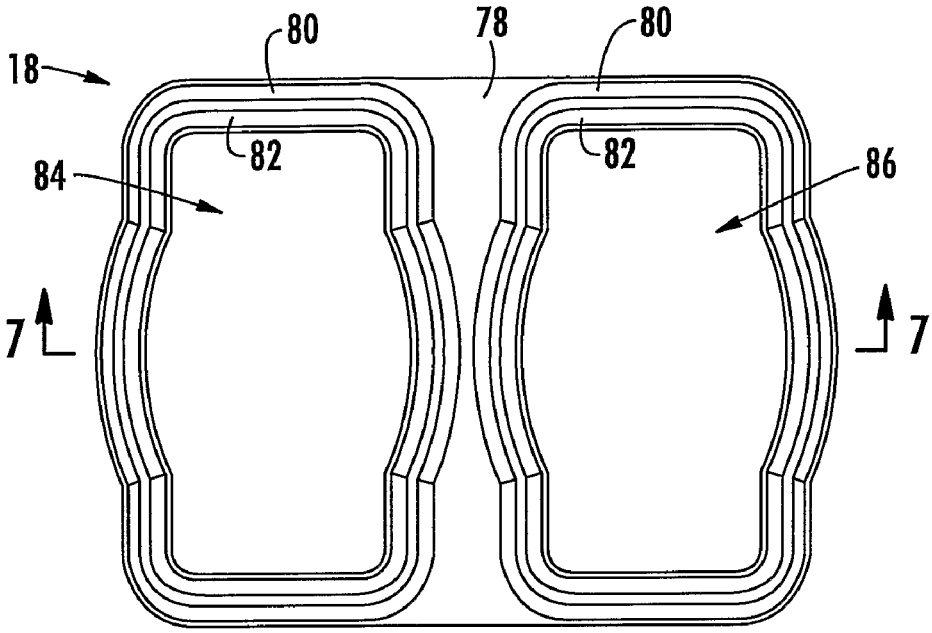
FIG. 6 is a top view of a gasket constructed in accordance with the present invention.
Figure 7:
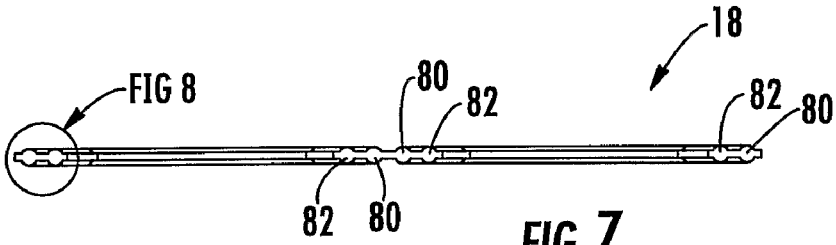
FIG. 7 is a view taken along lines 7-7 of FIG. 6.
Figure 8:
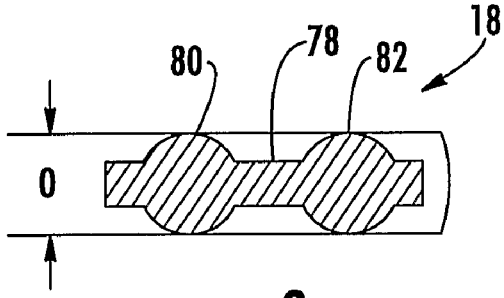
FIG. 8 is an enlarged view of a portion of the gasket of FIG. 7.

FIGS. 3, 4, and 5 illustrate the diaphragm 22 in more detail. The diaphragm 22 is constructed of a flexible, leakproof material. Any material which resists the expected fluids to be pumped and having the proper resiliency may be used. Examples of suitable materials include ethylene propylene diene terpolymer (EPDM) or VITON fluoroelastomer material. The diaphragm 22 has a generally cylindrical centrally-positioned stem 40 and a disk-shaped head 42, the upper surface of which forms the face 44 of the diaphragm 22. A central bore 46 is formed in the stem 40. An upstanding bead 48, which is shown in more detail in FIG. 5, is formed at the outer circumferential edge 50 of the diaphragm 22. The bead 48 comprises a flat, axially-facing surface 52 which is flanked by an outer angled surface 54 which faces radially outward, and an inner angled surface 56 which faces radially inward. Each of the angled surfaces 54 and 56 is disposed at an angle "A" measured from a reference line parallel to the longitudinal axis "L" of the diaphragm 22.

Figure 10:
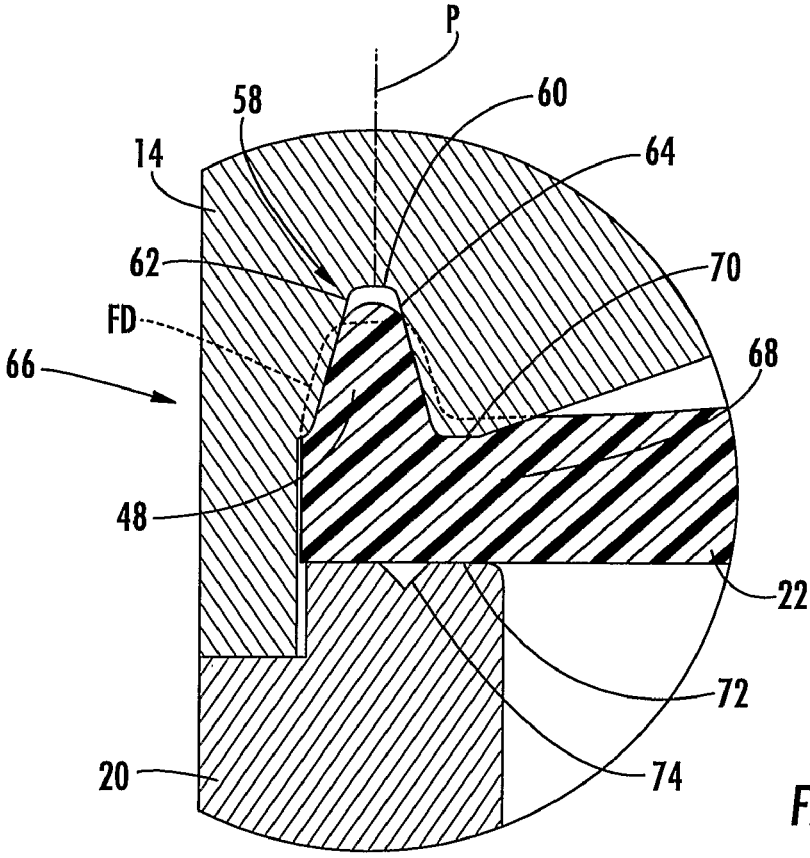
FIG. 10 is an enlarged sectional view of a portion of the pump of FIG. 1, showing a diaphragm installed therein.

FIG. 10 illustrates how the diaphragm 22 is mounted between the body 20 and the pump chamber 14. The chamber 14 includes a circumferentially extending wedge-shaped pocket 58 around its periphery that accepts the bead 48 of the diaphragm 22. The pocket 58 is generally the same cross-sectional shape as the bead 48 and includes an axially facing surface 60 flanked by first and second angled surfaces 62 and 64. The pocket 58 is disposed such that the centerline "B" of the bead 48 on the diaphragm 22 (See FIG. 5) coincides with the centerline "P" of the pocket 58. However, the dimensional relation between the bead 48 on the diaphragm 22 and the pocket 58 in the chamber 14 is such that when fully assembled there is a predetermined interference between the pocket 58 and the bead 48, compressing the bead 48 and forming a primary joint 66.

This interference causes a certain amount of compression force against each angled surface 54 and 56 of the bead 48. This compression forms a seal between the angled surfaces 54 and 56 of the diaphragm 22 and the contacting surfaces 62 and 64 of the chamber 14. Because the materials used in the diaphragm 22 are essentially incompressible, the pocket 58 in the chamber 14 has a depth greater than the height of the bead 48 which allows for the displacement of the bead material being compressed in the primary joint 66. In FIG. 10, the compressed shape of the diaphragm 22 is shown in solid lines, while the free shape of the diaphragm 22 is shown by the dashed line labeled "FD".

The symmetrically tapered design of the primary joint 66 creates two sealing surfaces with equal forces being applied to both sides. Because the resultant forces have both a horizontal vector (i.e. radially oriented relative to the pump centerline L) and a vertical vector (i.e. parallel to the pump centerline L), the primary joint 66 acts as both a sealing feature, preventing leaking between the chamber 14 and the body 20, and as a clamping feature, retaining the diaphragm 22 in place. The angle "A" may vary from about 10° to about 30°. Angles much less than about 10° begin to lose the vertical vector needed for an efficient clamping action. Angles much greater than about 30° will begin to lose the horizontal vector needed to create a robust sealing action. In the illustrated example, the angle "A" is about 15°.

The amount of interference is determined in part by the angle designed into the bead 48, the type of material used for the diaphragm 22 and the design of the diaphragm 22, including but not limited to its thickness and overall diameter. The illustrated design uses an amount of interference that equates to an overall compression rate of approximately 22%, however rates from about 16% to about 40% may be used. While the upper end of this range equates to what is considered an industry standard in an O-ring face seal condition, the tapered design of the bead 48 allows the low end of the compression rate to drop to a lower level and still retain excellent sealing and clamping characteristics In addition to the clamping action provided by the joint of the pocket 58 and bead 48, a compression force is applied to a small parallel-sided flat 68 of the diaphragm 22 disposed directly adjacent to the inner angled surface 56 of the bead 48. This width "W" of this flat 68 (see FIG. 4) can be as large as practical but should be no smaller than about 0.38 mm (0.015 in.) Exemplary values for the width W range from about 0.38 mm (0.015 in.) to about 0.51 mm (0.020 in.) This width is sufficient for use with a diaphragm about 2.54 cm (1 in.) in diameter. Larger diaphragms would likely need some increase in the width of this flat 68. The flat 68 is clamped between a circumferential upper rim 70 formed in the chamber 14, and a circumferential lower rim 72 formed in the body 20 which is bounded by a V-groove 74. The amount of compression on the flat 68 will be lower than that used in a prior art "face seal" design as the design of the pump 10 intentionally allows very little room for the displacement for the diaphragm 22 in this area. The illustrated example uses a compression rate of about 13.5%. However, depending on the overall design, compression rates of about 10% to about 25% would be appropriate for this clamping feature.

Figure 11:
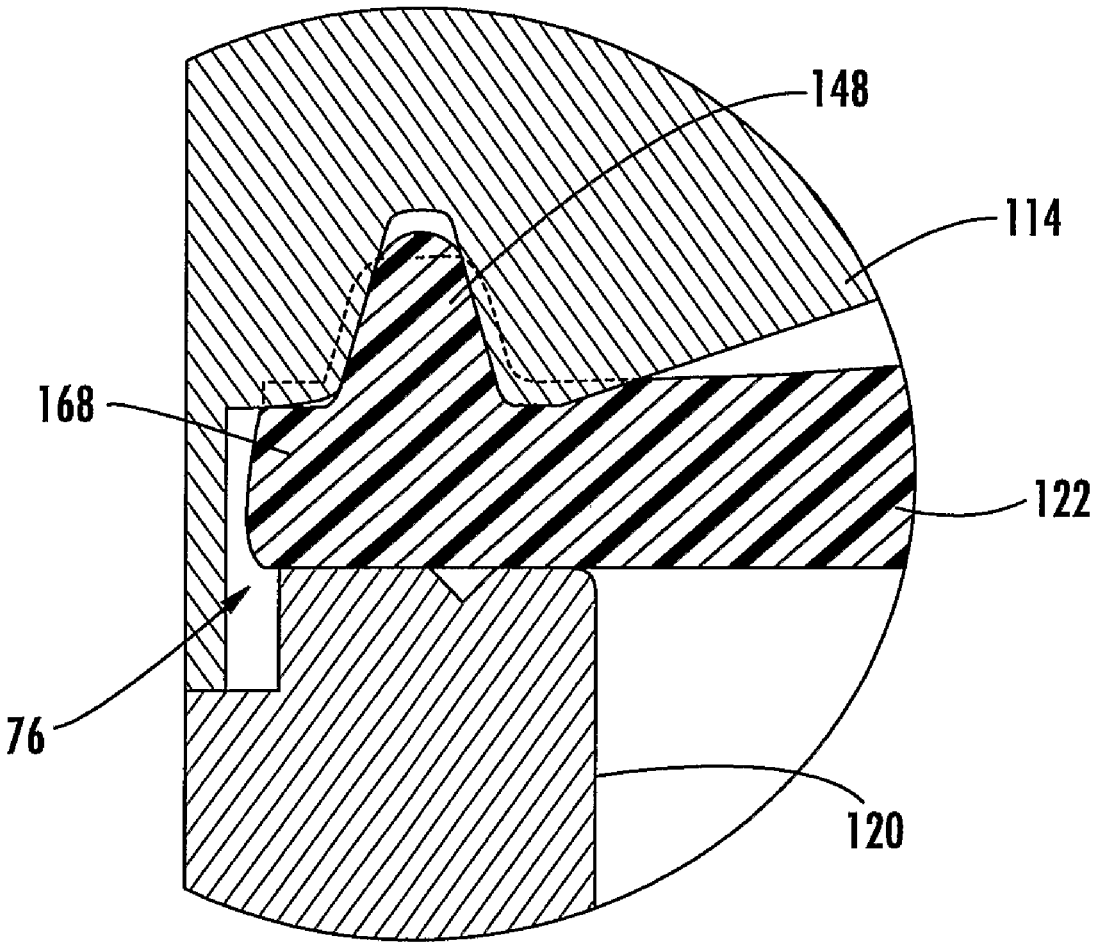
FIG. 11 is an enlarged sectional view of a portion of a pump chamber and body, showing an alternative embodiment of a diaphragm installed therein.

As an alternative, shown in FIG. 11, a diaphragm 122 having a flat 168 disposed radially outward of a bead 148 could be used between a chamber 114 and a body 120. With this embodiment, an area 76 could be supplied to capture further elastomer displacement. With this displacement accounted for, higher compression rates could easily be applied, for example upwards of 30% or 40%.

The flat 68 is not intended to be a primary sealing or clamping feature but is used as a secondary clamping feature that isolates the movement of the diaphragm 22 from the primary joint 66. This eliminates the potential for movement between the angled surfaces 54 and 56 of the diaphragm 22 and the mating surfaces 62 and 64 of the chamber 14 that create the tapered primary joint 66. By doing this, a permanent and secure joint is made between the diaphragm 22 and the chamber 14. There is also a benefit for the assembly process with this design. The tapered shapes of the bead 48 and the pocket 58 drive the diaphragm 22 into a true concentric position within the chamber 14 thus preventing misalignment of the diaphragm 22 during assembly. With a prior flat diaphragm or diaphragm having a straight sided bead, this benefit does not present itself.

Even though there will be tolerance stack-ups between the centerline diameter of the bead 48 and the pocket 58, the tapered joint design is forgiving enough to compensate for any expected variations between these two features. If, for example, the centerline diameter of the bead 48 (measured at line "B") was 0.254 mm (0.010 in.) larger or smaller than the centerline diameter of the pocket 58 (measured at line "P"), the bead 48 will still begin alignment into the pocket 58 during assembly and be either pulled radially outward or pushed radially inward respectively, forcing the components to seat together as intended.

Turning now to FIGS. 6-9, the gasket 18 is illustrated in more detail. The gasket 18 is constructed of a flexible, leakproof material. Any material which resists the expected fluids to be pumped and having the proper resiliency may be used. Examples of suitable materials include ethylene propylene diene terpolymer (EPDM), fluoroelastomers and perfluoroelastomers, and VITON fluoroelastomer material. The gasket 18 is a continuous member including a flat web 78, a pair of spaced-apart circular section outer beads 80 and 80', and a pair of spaced-apart circular section inner beads 82 and 82', each having a diameter "O". If desired, only one bead, or multiple beads could be used. In plan view the gasket 18 is patterned so that the beads 80 and 82 surround the perimeter of the area or areas to be sealed. In the particular example illustrated the gasket 18 includes two generally rectangular areas 84 and 86.

Figure 9:
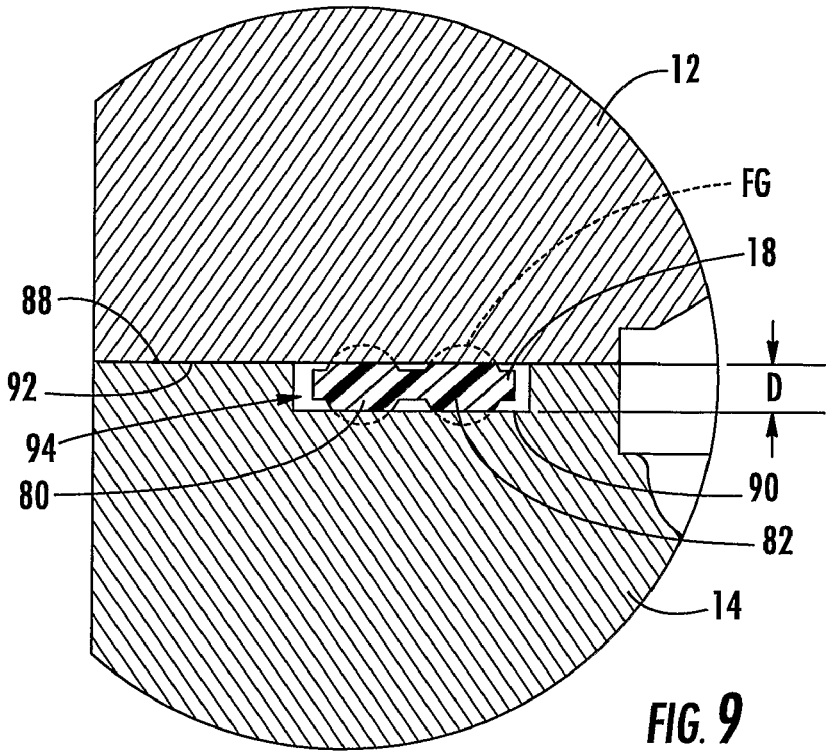
FIG. 9 is an enlarged sectional view of a portion of the pump of FIG. 1, showing a gasket installed therein.

FIG. 9 illustrates how the gasket 18 is mounted between the head 12 and the chamber 14. The gasket 18 is received between a planar lower surface 88 of the head 12 and a groove 90 formed in the upper surface 92 of the chamber 14, which cooperatively define a gland 94. The dimensions of the gland 94 are chosen such that when fully assembled there is a predetermined interference between the gland 94 and the gasket beads 80 and 82, forming a seal. In FIG. 9 the compressed shape of the gasket 18 is shown in solid lines, while the free shape is shown in dashed lines marked "FG". Because this seal is a permanent static seal it has been found that high compression of the gasket beads 80 and 82 can be applied without adverse consequences. Because of the design of the gland 94, there is adequate space for the deformation of the gasket 18 under high compression conditions.

The prior art recommended range of compression on a static O-ring face seal is about 20% to about 40%. This typical range of static compression works well, but if needed, compression amounts of up to about 50% or 60% can be applied to the gasket beads 80 and 82. This is a benefit when working with plastic parts molded with certain advanced engineered resins. Some of these plastic materials have a tendency to exhibit distorted post-molding conditions such as sinking or warping which will in effect cause the depth of the gland 94 to vary. The smaller the nominal depth of the gland 94, the more effect a given amount of distortion will have. Though these plastic distortions are never desirable, they are inherent when working with plastic injection molded parts, especially when working with some of the materials required for certain compatibility properties or other physical characteristics.

For example, the gland 94 might have nominal depth D of 0.89 mm (0.035 in.) A typical O-ring design allowing for a 35% compression ratio would have a nominal diameter of 1.37 mm (0.054 in.) If both the head 12 and chamber 14 have a degree of sinking and/or warping that combine to add 0.20 mm (0.008 in.) to some areas of the gland 94, it would be desirable to allow for the 35% compression rate at the greatest depth of 1.09 mm (0.043 in.) Therefore an O-ring diameter "O" of 1.68 mm (0.066 in.) could be used for the gasket beads 80 and 82. This would then create a compression of 47% where the gland depth D was only 0.89 mm (0.035 in.) While this is a higher compression rate than is considered within the industry acceptable range, the present design allows the higher compression to work effectively to seal this joint.

The foregoing has described a diaphragm pump having a unique sealing arrangement. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A sealing arrangement for a pump, comprising:

a first member having a peripheral wedge-shaped pocket formed therein;

a second member with a rim opposed to said pocket;

a diaphragm disposed between said first and second members, comprising:

a central stem having a longitudinal axis;

a disk-shaped head attached to said stem; and an upstanding bead disposed around the periphery of said head, said bead including a generally radially-outwardly facing first angled surface, and a generally radially-inwardly facing second angled surface;

wherein said bead is received in said pocket so as to form two separate, spaced-apart sealing surfaces between said diaphragm and said first member.

2. The sealing arrangement of claim 1 wherein each of said angled surfaces is disposed at an angle of about 10 degrees to about 30 degrees to said longitudinal axis.

3. The sealing arrangement of claim 2 wherein each of said angled surfaces is disposed at an angle of about 15 degrees to said longitudinal axis.

4. The sealing arrangement of claim 1 wherein said bead includes a substantially flat, axially-facing surface disposed between said angled surfaces.

5. The sealing arrangement of claim 1 wherein:

said diaphragm includes a substantially parallel-sided first flat portion disposed adjacent to said second angled surface; and said first flat portion is clamped between said first and second members.

6. The sealing arrangement of claim 1 wherein:

said diaphragm includes a substantially parallel-sided second flat portion disposed adjacent to the second angled surface; and said second flat portion is clamped between said first and second members.

7. The sealing arrangement of claim 1 wherein a V-shaped groove is formed in said rim.

8. The sealing arrangement of claim 1 wherein said diaphragm comprises a material selected from the group consisting of a fluoroelastomer, ethylene propylene diene terpolymer, and combinations thereof.

9. The sealing arrangement of claim 1 wherein said pocket includes a generally radially-outwardly facing third angled surface, and a generally radially-inwardly facing fourth angled surface.

10. A sealing arrangement, comprising:

first and second members each having a planar surface, said members cooperatively defining a gland for receiving a gasket;

a gasket made from a resilient material disposed in said gland, said gasket including a flat web, and a circular cross-section first bead extending in a first closed path;

wherein the dimensions of said first bead and said first and second members are selected such that said first bead is diametrically compressed at least about 40% from its free state.

11. The sealing arrangement of claim 10 wherein said first bead is compressed about 50% to about 60% from its free state.

12. The sealing arrangement of claim 10 wherein said gasket further includes a circular cross-section second bead extending in a closed path inside of said first closed path and received in said gland, wherein the dimensions of said second bead and said first and second members are selected such that said second bead is diametrically compressed at least about 40% from its free state.

13. The sealing arrangement of claim 12 wherein said second bead is compressed about 50% to about 60% from its free state.

14. The sealing arrangement of claim 10 wherein said gasket comprises a material selected from the group consisting of a fluoroelastomer, a perfluoroelastomers ethylene propylene diene terpolymer, and combinations thereof.

15. A pump, comprising:

a pump head having a peripheral wedge-shaped pocket formed therein;

a body having a rim opposed to said pocket;

a diaphragm disposed between said pump head and said body, comprising:

a central stem positioned having a longitudinal axis;

a disk-shaped head attached to said stem; and an upstanding diaphragm bead disposed around the periphery of said head, said diaphragm bead including a generally radially-outwardly facing first angled surface, and a generally radially-inwardly facing second angled surface;

wherein said diaphragm bead is received in said pocket so as to form two separate sealing surfaces between said pump head and said diaphragm.

16. The pump of claim 15, wherein said pump head comprises a chamber and a head having mating planar surfaces, said chamber and said head cooperatively defining a gland for receiving a gasket, said pump further comprising:

a gasket made from a resilient material disposed in said gland, said gasket including a flat web, and a circular cross-section first bead extending in a first closed path;

wherein the dimensions of said first bead and said first and second members are selected such that said first bead is diametrically compressed at least about 40% from its free state.

17. The pump of claim 16 wherein said first bead is compressed about 50% to about 60% from its free state.

18. The pump of claim 16 wherein said gasket further includes a circular cross-section second bead extending in a closed path inside of said first closed path and received in said gland, wherein the dimensions of said second bead, said head, and said chamber are selected such that said second bead is diametrically compressed at least about 40% from its free state.

19. The pump of claim 18 wherein said second bead is compressed about 50% to about 60% from its free state.

20. The pump of claim 16 wherein said diaphragm comprises a material selected from the group consisting of a fluoroelastomer, ethylene propylene diene terpolymer, and combinations thereof.

* * * * *